United States Patent [19]

Nakamura et al.

[11] Patent Number: 4,862,705

[45] Date of Patent: Sep. 5, 1989

[54] AIR CONDITIONER

[75] Inventors: Takashi Nakamura, Wakayama; Hitoshi Iijima, Amagasaki, both of Japan

[73] Assignee: Mitsubishi Denki Kabushiki Kaisha, Tokyo, Japan

[21] Appl. No.: 265,512

[22] Filed: Nov. 1, 1988

[30] Foreign Application Priority Data

Nov. 18, 1987 [JP] Japan ..... 62-292712

[51] Int. Cl.[4] ..... F25B 27/00

[52] U.S. Cl. ..... 62/324.1; 62/324.6

[58] Field of Search ..... 62/324.1, 324.6, 160, 62/238.7

[56] References Cited

U.S. PATENT DOCUMENTS

| | | | |
|---|---|---|---|
| 2,893,218 | 7/1959 | Harnish | 62/324.1 X |
| 2,907,178 | 10/1959 | McNatt | 62/160 X |
| 4,104,890 | 8/1978 | Iwasaki | 62/324.1 |
| 4,620,423 | 11/1986 | Hopkinson et al. | 62/324.6 X |
| 4,771,610 | 9/1988 | Nakashima et al. | 62/324.1 X |

FOREIGN PATENT DOCUMENTS 62-56429 11/1987 Japan .

*Primary Examiner*—Lloyd L. King

*Attorney, Agent, or Firm*—Oblon, Spivak, McClelland, Maier & Neustadt

[57] ABSTRACT

A multi-room type of heat pump air conditioner comprises an outdoor unit including a compressor, an outdoor four-way valve and an outdoor heat exchanger, a plurality of indoor units, each including an indoor heat exchanger and a throttle device, and the indoor units being connected in parallel by means of a first and a second connecting pipe so as to form a refrigerating cycle, wherein each indoor heat exchanger has one end connected to an indoor four-way valve so as to switch the end from one of the first and the second connecting pipe to the other; each indoor heat exchanger has the other end connected to a third connecting pipe for connecting between the indoor units, through the throttle device, and the third connecting pipe and the indoor four-way valve are connected to each other through an opening and closing valve in each indoor unit.

1 Claim, 3 Drawing Sheets

AIR CONDITIONER

The present invention relates to a multi-room type of heat pump air conditioner wherein a single outdoor unit is connected to a plurality of indoor units, in particular to the air conditioner capable of carrying out heating and cooling at the same time.

There has been known a heat pump air conditioner wherein a single outdoor unit is connected to a plurality of indoor units by two pipes, i.e. a gas pipe and a liquid pipe to carry out heating and cooling, all the indoor units being formed so as to carry out heating at the same time or to carry out cooling at the same time.

Since the conventional multi-room type air condition has been constructed as described above, all the indoor units carry out the same operation mode, i.e. heating or cooling. This creates a problem wherein heating is carried out in a place required for cooling or cooling is carried out in a place required for heating.

In particular, when such type of air conditioner is installed in a large-scale building, an interior portion, a perimeter portion or an ordinary office is remarkably different from a room with an office automation system such as a computer room in terms of heating load and cooling load, which is a typical problem.

It is an object of the present invention to eliminate the problems as described above, and to provide a multi-room type of heat pump air conditioner wherein a single outdoor unit is connected to a plurality of indoor units, and at least one of indoor units can carry out an air conditioning mode, i.e. cooling or heating, while another indoor unit is carrying out a different air conditioning mode, i.e. heating or cooling, thereby meeting requirements even if an interior portion, a perimeter portion or an ordinary office is quite different from an office automation room in a large-scale building and so on in terms of heating and cooling loads.

The foregoing and the other objects of the present invention have been attained by providing a multi-room type of heat pump air conditioner wherein there are provided a first and a second connecting pipe which connect between an outdoor unit and a plurality of indoor units, there is also provided a third connecting pipe which connects between the indoor units, the indoor heat exchanger in each indoor unit has one end connected to an indoor four-way valve so that the end can be connected to one of the first and the second connecting pipe, the indoor heat exchanger has the other end connected to the third connecting pipe through a throttle device, and the third connecting pipe and the indoor four-way valve are connected to each other through a fourth connecting pipe with an opening and closing valve in it.

When all of the indoor units carry out heating, the indoor unit four-way valves are switched and the opening and closing valves are opened so that a refrigerant flows in the order of the first connecting pipe as a high pressure gas pipe, the indoor four-way valves, the indoor heat exchangers, the throttle devices, the opening and closing valves, the indoor four-way valves and the second connecting pipe as a low pressure gas pipe. When at least one of the indoor units carries out cooling, the opening and closing valves in the all of the indoor units are closed, and the indoor four-way valve in the indoor unit which carries out cooling is switched to connect the indoor heat exchanger to the second connecting pipe, thereby allowing the cooling operation to be carried out in the unit.

When all of the indoor units carry out cooling, the indoor four-way valves are switched and the opening and closing valves are opened so that the refrigerant flows in the units in the order of the second connecting pipe as a high pressure liquid pipe, the indoor four-way valves, the opening and closing valves, the throttle devices, the indoor heat exchangers, the indoor four-way valves and the first connecting pipe as the low pressure gas pipe.

When a portion of the indoor units carries out heating, the opening and closing valves in all of the indoor units are closed, and the indoor four-way valve in the indoor unit which is to be carry out heating is switched to connect the indoor heat exchanger to the second connecting pipe, allowing the heating operation to be carried out in the unit.

The present invention allows the indoor units to carry out cooling operation and heating operation independently at the same time, which has been impossible up to now. In order to realize such operation, it is enough to add the third connecting pipe. The number of the long connecting pipes for connecting the outdoor unit to the indoor units is two, which is the same as the conventional air conditioner. It is possible to install the air conditioner without difficulty and at low cost, which is advantageous.

Figure 2:
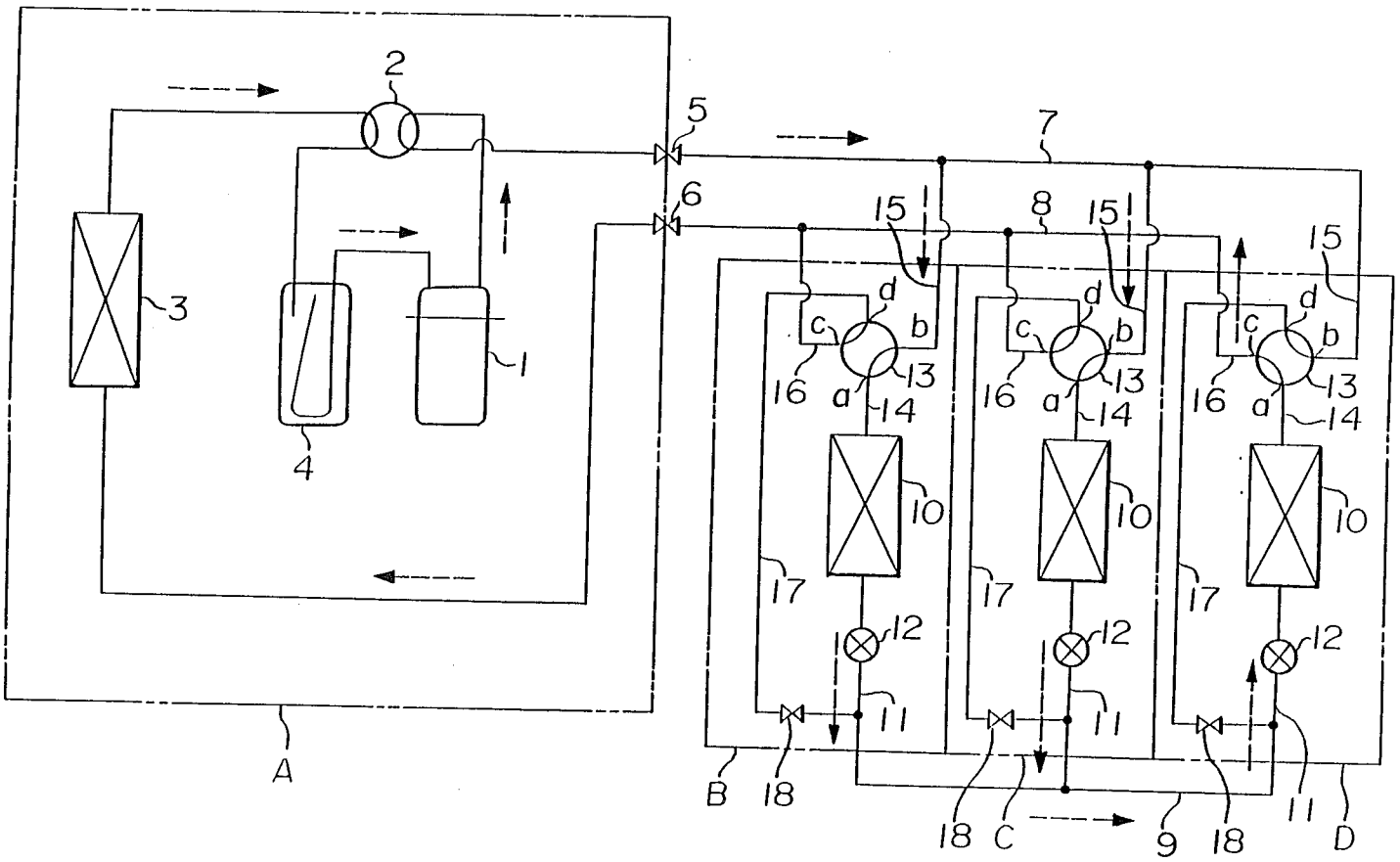
FIG. 2 is a diagram of the embodiment showing how the refrigerant flows at the time of carrying out heating with two indoor units and carrying out cooling with one indoor unit.
Figure 3:
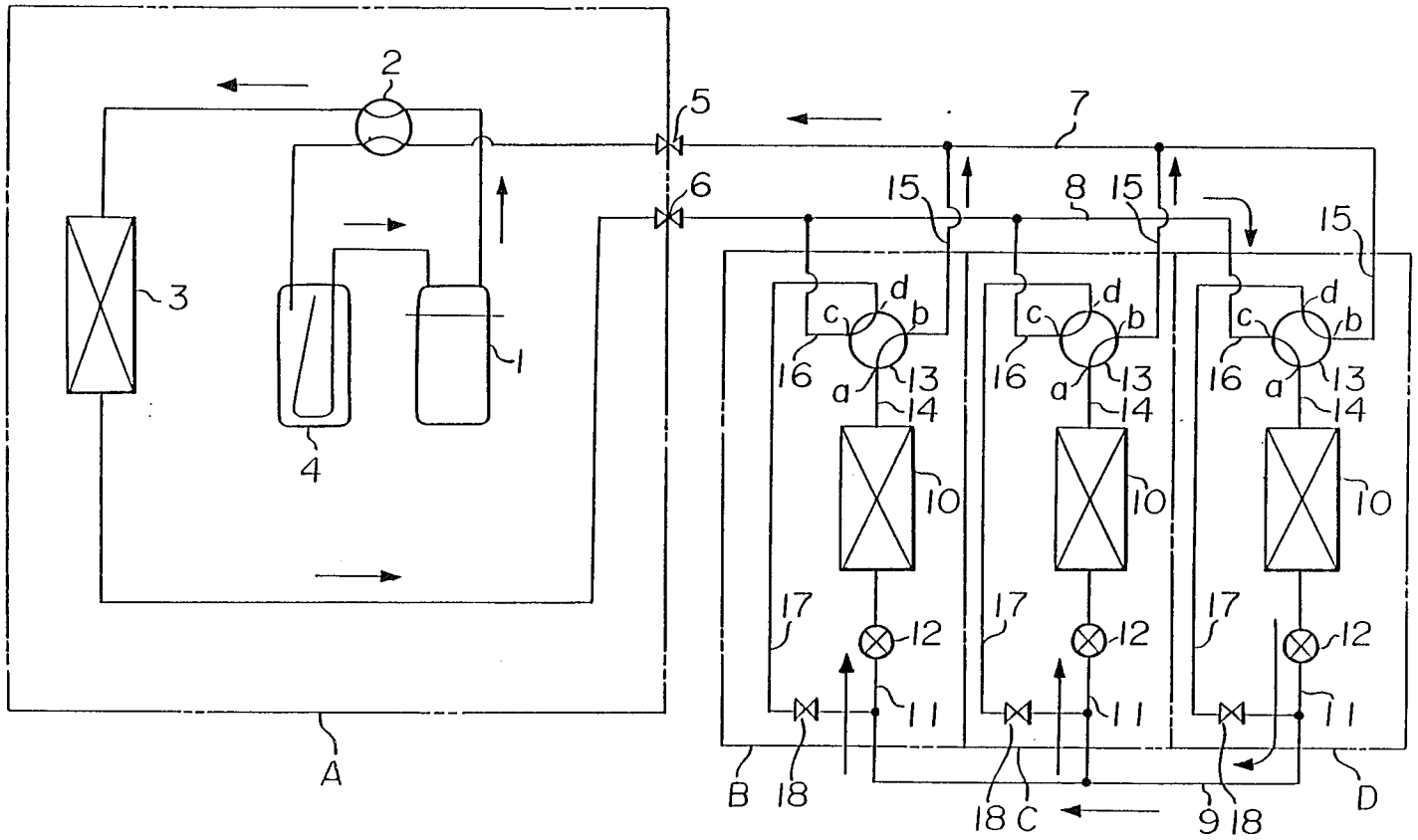
FIG. 3 is a diagram of the embodiment showing how the refregerant flows at the time of carrying out cooling with two indoor units and carrying out heating with one unit.

Now, the present invention will be described in detail with reference to a preferred embodiment illustrated in FIGS. 1 through 3.

The explanation on the embodiment will be made on the case wherein a single outdoor unit is connected to three indoor units. The present invention is of course applicable to the case wherein a single outdoor unit is connected to more than one indoor unit. Reference numeral A designates an outdoor unit. Reference numerals B, C and D designate indoor units which are connected in parallel and which have the same structure as one another. The outdoor unit includes a compressor 1, an outdoor four-way valve 2, an outdoor heat exchanger 3, an accumulator 4, a first connector 5, and a second connector 6. To the first connector 5 is connected a first connecting pipe 7 which is used to connect the outdoor unit A to the indoor units B, C and D. To the second connector 6 is connected a second connecting pipe 8 which is used to connect the outdoor unit A to the indoor units B, C and D.

Each indoor unit includes an indoor heat exchanger 10, a pipe 11 for connecting one end of the indoor heat exchanger 10 to a third connecting pipe 9, a throttle device 12 which is put in the pipe 11 so as to be opened and closed, an indoor four-way valve 13 having connections a, b, c and d, a pipe 14 for connecting the other end of the indoor heat exchanger 10 to the connection a of the indoor four-way valve 13, a pipe 15 for connecting the first connecting pipe 7 to the connection b of the indoor four-way valve 13, a pipe 16 for connecting the second connecting pipe 8 to the connection c of the indoor four-way valve 13, a fourth connecting pipe 17 for connecting the connection d of the four-way valve 13 to the pipe 11, and an opening and closing valve 18 which is put in the pipe 17. The third connecting pipe 9 connects with the pipes 11 and the fourth connecting pipes 17 in the indoor units B, C and D.

The operation of the embodiment will be explained.

Figure 1:
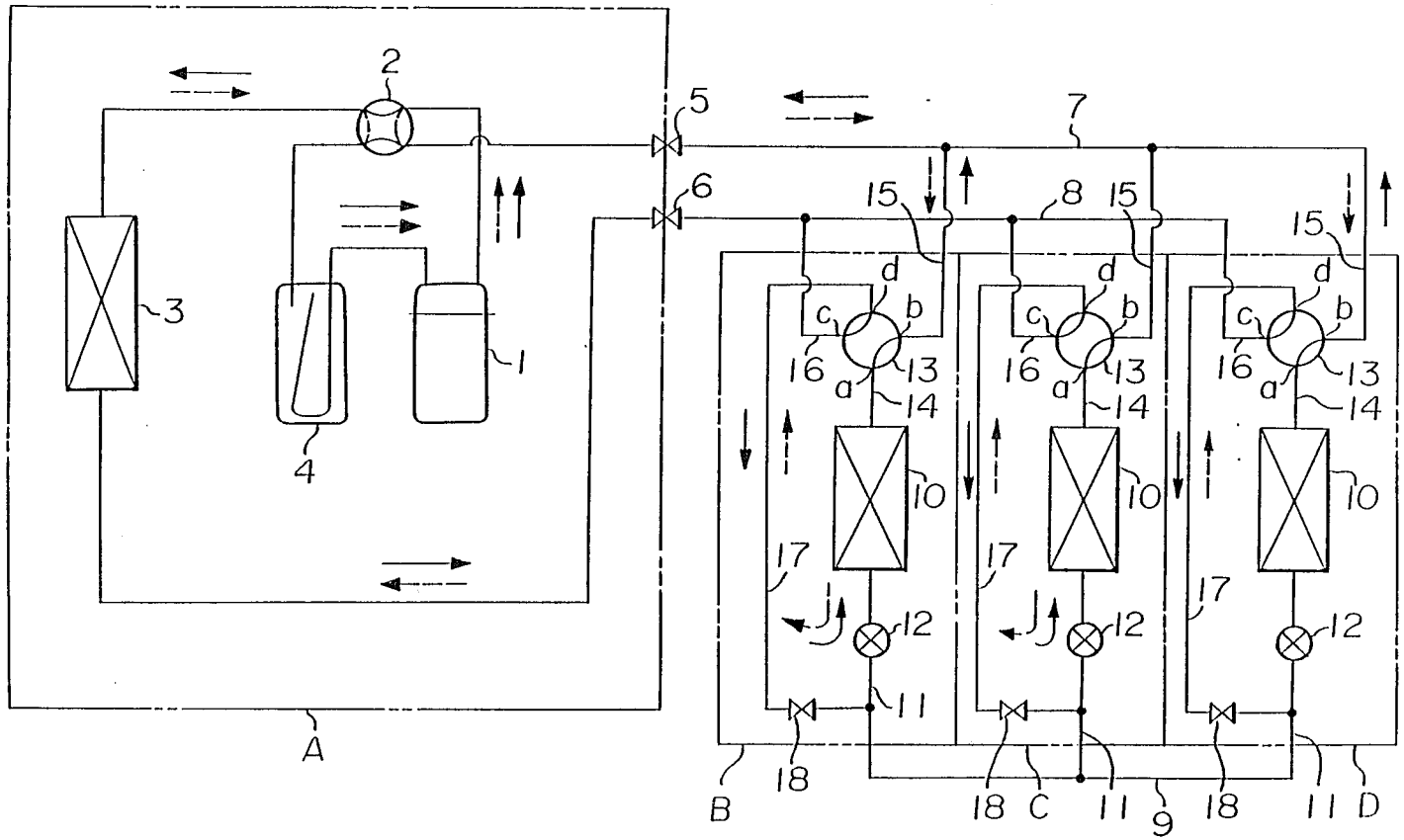
FIG. 1 is a diagram of an embodiment according to the present invention showing how a refrigerant flows at the time of carrying out cooling and heating in all indoor units.

In FIG. 1, an arrow with a solid line indicates the flow of the refrigerant on cooling, and an arrow with a dotted line indicates the flow of the refrigerant on heating.

When all the indoor units B, C and D are carrying out cooling, the gaseous refrigerant from the compressor 1, which is at a high temperature and under a high pressure, flows into the outdoor heat exchanger 3 through the outdoor four-way valve 2. In the outdoor heat exchanger, it is condensed to become the liquid refrigerant having a high temperature under a high pressure. The liquid refrigerant flows into the pipes 16 in the indoor units B, C and D through the second connection 6 and the second connecting pipe 8. Then, the liquid refrigerant is depressurized in the throttle devices 12 through the indoor four-way valves 13, the fourth connecting pipes 17, the opening and closing valves 18 and the pipes 11. After that, the refrigerant comes into the indoor heat exchangers 10 where it is evaporated to become the gaseous refrigerant having a low temperature and a low pressure, thereby cooling the rooms with the indoor units installed in them. The refrigerant which has gone out of the indoor heat exchangers flows back to the compressor 1 through the pipes 14, the indoor four-way valves 13, the pipes 15, the first connecting pipe 7, the first connection 5, the outdoor four-way valve 2 and the accumulator 4.

When all the indoor units B, C and D are carrying out heating, the gaseous refrigerant from the compressor 1, which is at a high temperature under a high pressure, flows into the pipes 15 in the indoor units B, C and D through the outdoor four-way valve 2, the first connection 5 and the first connecting pipe 7. The gaseous refrigerant flows into the indoor heat exchanger 10 through the indoor four-way valves 13 and the pipes 14. In the indoor heat exchangers, the gaseous refrigerant is condensed to become the liquid refrigerant having a high temperature under a high pressure, thereby heating the rooms with the indoor units installed in them. The liquid refrigerant is depressurized in the throttle devices 12 to become the two-phase refrigerant having a low temperature under a low pressure. The two phase refrigerant flows into the outdoor heat exchanger 3 through the pipes 11, the opening and closing valves 18, the fourth connecting pipes 17, the indoor four-way valves 13, the pipes 16, the second connecting pipe 8 and the second connection 6. In the outdoor heat exchanger, the refrigerant is evaporated to become the gaseous refrigerant having a low temperature under a low pressure. The gaseous refrigerant goes out of the outdoor heat exchanger 3 and flows back to the compressor 1 through the outdoor four-way valve 2 and the accumulator 4.

Now, the case wherein the two indoor units B and C are carrying out heating, and at the same time, the indoor unit D is carrying out cooling, i.e. wherein heating load is greater than cooling load will be explained in reference to FIG. 2.

The outdoor unit A is operated in the same way as the heating operation as described above, because the heating load is greater. The opening and closing valves 18 in the indoor units B, C and D are closed. The indoor four-way valve 13 in the indoor unit D which carries out cooling is switched so as to flow the refrigerant in the order of the pipe 11, the throttle device 12, the indoor heat exchanger 10, the pipe 14, the indoor four-way valve 13, the pipe 16 and the second connecting pipe 8. The four-way valves 13 in the indoor units B and C keep the same position as that as shown in FIG. 1. As a result, the gaseous refrigerant from the compressor 1, which is at a high temperature under a high pressure, flows into the pipes 15 in the indoor units B and C through the outdoor four-way valve 2, the first connection 5 and the first connecting pipe 7. And the refrigerant comes into the indoor heat exchangers 10 through the indoor four-way valves 13 and the pipes 14. In the indoor heat exchanger, the refrigerant carries out heat exchanging, i.e. heats the rooms with the indoor units B and C installed in them on condensing, thereby becoming the liquid refrigerant having a high temperature under a high pressure. The liquid refrigerant is slightly depressurized in the throttle devices 12 and flows into the third connecting pipe 9 through the pipes 11. The liquid refrigerant flows into the pipe 11 in the indoor unit D and is depressurized in the throttle device in the indoor unit D to become the two-phase refrigerant having a low temperature under a low pressure. The two-phase refrigerant comes into the indoor heat exchanger 10 in the indoor unit D, where it is evaporated to cool the inside of the room with the indoor unit D installed and to become the two-phase refrigerant which is much drier and has a low temperature under a low pressure. Then, the two-phase refrigerant flows into the second connecting pipe 8 through the pipe 14, the indoor four-way valve 13 and the pipe 16 in the unit D. After that, it flows into the outdoor heat exchanger 3 through the second connection 6, where it is evaporated to become the gaseous refrigerant having a low temperature under a low pressure. After that, the gaseous refrigerant flows back to the compressor 1 through the outdoor four-way valve 2 and accumulator 4.

Next, the case wherein the two indoor units B and C are carrying out cooling, and at the same time, the indoor unit D is carrying out heating, i.e. wherein cooling load is greater than heating load will be explained in reference to FIG. 3.

The outdoor unit A is operated in the same way as the cooling operation because the cooling load is greater. The opening and closing valve 18 in the indoor units B, C and D are closed. The indoor four-way valve 13 in the indoor unit D which carries out heating is switched so as to flow the refrigerant in the order of the second connecting pipe 8, the pipe 16, the indoor four-way valve 13, the pipe 14, the indoor heat exchanger 10, and the throttle device 12 in the unit D. The four-way valves 13 in the indoor units B and C keep the same position as that as shown in FIG. 1. As a result, the gaseous refrigerant from the compressor 1, which is at a high temperature under a high pressure, flows into the outdoor heat exchanger 3 through the outdoor four-way valve 2. In the outdoor heat exchanger, it is condensed to become the two-phase refrigerant having a high temperature under a high pressure. The two-phase refrigerant flows into the pipe 16 in the indoor unit D through the second connection 6 and the second connecting pipe 8. The refrigerant comes into the indoor heat exchanger 10 through the indoor four-way valve 13 and the pipe 14 in the unit D. In the indoor heat exchanger, the refrigerant carries out heat exchanging, i.e. heats the inside of the room with the unit D installed so as to become the liquid refrigerant having a high temperature under a high pressure. After that, the liquid refrigerant is slightly depressurized in the throttle device 12 and flows into the third connecting pipe 9 through the pipe 11. The liquid refrigerant flows into the pipes 11 in the indoor units D and C. The refrigerant which has entered the pipes 11 is depressuried in the throttle devices 12 to become the two-phase refrigerant having a low temperature under a low pressure in the units D and C, which comes into the indoor heat exchangers 10 and carries out heat-exchanging there to carry out cooling on evaporating. The gaseous refrigerant which has become a low temperature under a low pressure flows back to the compressor 1 through the pipes 14, the indoor four-way valves 13, the pipes 15, the first connecting pipe 7, the first connection 5, the outdoor four-way valve 2 and the accumulator 4.

We claim:

1. A multi-room type of heat pump air conditioner comprising:

an outdoor unit including a compressor, an outdoor four-way valve and an outdoor heat exchanger, a plurality of indoor units, each including an indoor heat exchanger and a throttle device, and the indoor units being connected in parallel by means of a first and a second connecting pipe so as to form a refrigerating cycle, wherein each indoor heat exchanger has one end connected to an indoor four-way valve so as to switch the end from one of the first and the second connecting pipe to the other; each indoor heat exchanger has the other end connected to a third connecting pipe for connecting between the indoor units, through the throttle device, and the third connecting pipe and the indoor four-way valve are connected to each other through an opening and closing valve in each indoor unit.

* * * * *